US007222680B2

(12) United States Patent
Livingston et al.

(10) Patent No.: US 7,222,680 B2
(45) Date of Patent: May 29, 2007

(54) PNEUMATIC MOTOR IMPROVEMENTS AND PNEUMATIC TOOLS INCORPORATING SAME

(75) Inventors: Patrick S. Livingston, Easton, PA (US); Karl C. Austin, Bucksport, ME (US)

(73) Assignee: Ingersoll-Rand Company, Montvale, NJ (US)

( * ) Notice: Subject to any disclaimer, the term of this patent is extended or adjusted under 35 U.S.C. 154(b) by 0 days.

(21) Appl. No.: 11/000,664

(22) Filed: Dec. 1, 2004

(65) Prior Publication Data

US 2006/0113099 A1 Jun. 1, 2006

(51) Int. Cl.
*F01C 21/00* (2006.01)
*B25D 15/00* (2006.01)

(52) U.S. Cl. ..... 173/177; 173/218; 173/168

(58) Field of Classification Search ..... 173/177, 173/218, 221, 168; 60/370, 407, 493
See application file for complete search history.

(56) References Cited

U.S. PATENT DOCUMENTS 3,610,343 A * 10/1971 Bratt ..... 173/177
3,661,217 A 5/1972 Maurer
3,767,335 A * 10/1973 Kramer et al. ..... 418/259
4,578,948 A * 4/1986 Hutson et al. ..... 60/487
4,822,264 A 4/1989 Kettner
5,007,778 A 4/1991 Hillestad et al.
5,087,180 A 2/1992 Clapp
5,293,747 A * 3/1994 Geiger ..... 60/493
5,309,714 A * 5/1994 Putney et al. ..... 60/407
5,346,024 A * 9/1994 Geiger et al. ..... 173/221
5,689,956 A * 11/1997 Reboredo ..... 60/491
5,918,686 A 7/1999 Izumisawa
6,082,986 A * 7/2000 Seward et al. ..... 418/270
6,106,255 A 8/2000 Viegas et al.
6,161,627 A 12/2000 Seith et al.
6,250,399 B1 6/2001 Giardino
6,796,386 B2 * 9/2004 Izumisawa et al. ..... 173/93.5
6,880,645 B2 * 4/2005 Izumisawa ..... 173/93.5

FOREIGN PATENT DOCUMENTS

EP 0566227 10/1993
GB 434676 9/1935

* cited by examiner

*Primary Examiner*—Brian D. Nash
(74) *Attorney, Agent, or Firm*—Michael Best & Friedrich LLP

(57) ABSTRACT

A pneumatic motor having a motor chamber having an inner surface with an eccentric longitudinal axis, a motive gas fluid inlet, and at least one end wall located transversely to the longitudinal axis with an exhaust aperture located therethrough. A rotor is rotatably disposed in the motor chamber on the eccentric longitudinal axis and having a plurality of radial slots, the rotor defining a first rotational position with respect to the longitudinal axis at which the distance between the rotor and the motor chamber is a minimum. A plurality of vanes is slidably carried within the plurality of radial slots and rotationally moving between the fluid inlet and the exhaust aperture during rotation of the rotor. The exhaust aperture is located at a second rotational position with respect to the longitudinal axis such that during rotation of the rotor, the angular distance traveled by each of the plurality of vanes between the first rotational position and the second rotational position in a first rotational direction is greater than 180 degrees.

17 Claims, 8 Drawing Sheets

PNEUMATIC MOTOR IMPROVEMENTS AND PNEUMATIC TOOLS INCORPORATING SAME

BACKGROUND OF THE INVENTION

This invention relates generally to rotary pneumatic motors and pneumatic tools incorporating the same, and more particularly to rotary pneumatic air motors and pneumatic tools having improved performance and bias capabilities.

Conventional rotary pneumatic tools, such as impact wrenches, comprise a housing and a pneumatic motor disposed in the housing. The pneumatic motor is powered by pressurized air received in the housing that drives rotation of a shaft supported by the housing. The shaft projects outward from the housing for engaging a fastener element, such as a nut or a bolt. The tools are typically provided with a control mechanism for switching the mode of operation of the tool between a forward operating mode in which the fastener element is tightened and a reverse operating mode in which the fastener element is loosened. Because many times fastener elements to be loosened are rusted, corroded, and/or damaged, it is often desirable to design the tool with a reverse bias in which the maximum torque of the tool occurs in the reverse direction.

The foregoing illustrates limitations known to exist in present pneumatic devices. Thus it is apparent that it would be advantageous to provide an alternative directed to overcoming one or more of the limitations set forth above. Accordingly, pneumatic motor improvements and pneumatic tools incorporating the same are provided including the features more fully disclosed hereinafter.

SUMMARY OF THE INVENTION

According to the present invention, a pneumatic motor is provided having a motor chamber having an inner surface with an eccentric longitudinal axis, a motive gas fluid inlet, and at least one end wall located transversely to the longitudinal axis with an exhaust aperture located therethrough. A rotor is rotatably disposed in the motor chamber on the eccentric longitudinal axis and having a plurality of radial slots, the rotor defining a first rotational position with respect to the longitudinal axis at which the distance between the rotor and the motor chamber is a minimum. A plurality of vanes is slidably carried within the plurality of radial slots and rotationally moving between the fluid inlet and the exhaust aperture during rotation of the rotor. The exhaust aperture is located at a second rotational position with respect to the longitudinal axis such that during rotation of the rotor, the angular distance traveled by each of the plurality of vanes between the first rotational position and the second rotational position in a first rotational direction is greater than 180 degrees.

The foregoing and other aspects will become apparent from the following detailed description of the invention when considered in conjunction with accompanying drawing figures.

DETAILED DESCRIPTION OF THE PREFERRED EMBODIMENTS

Figure 1:
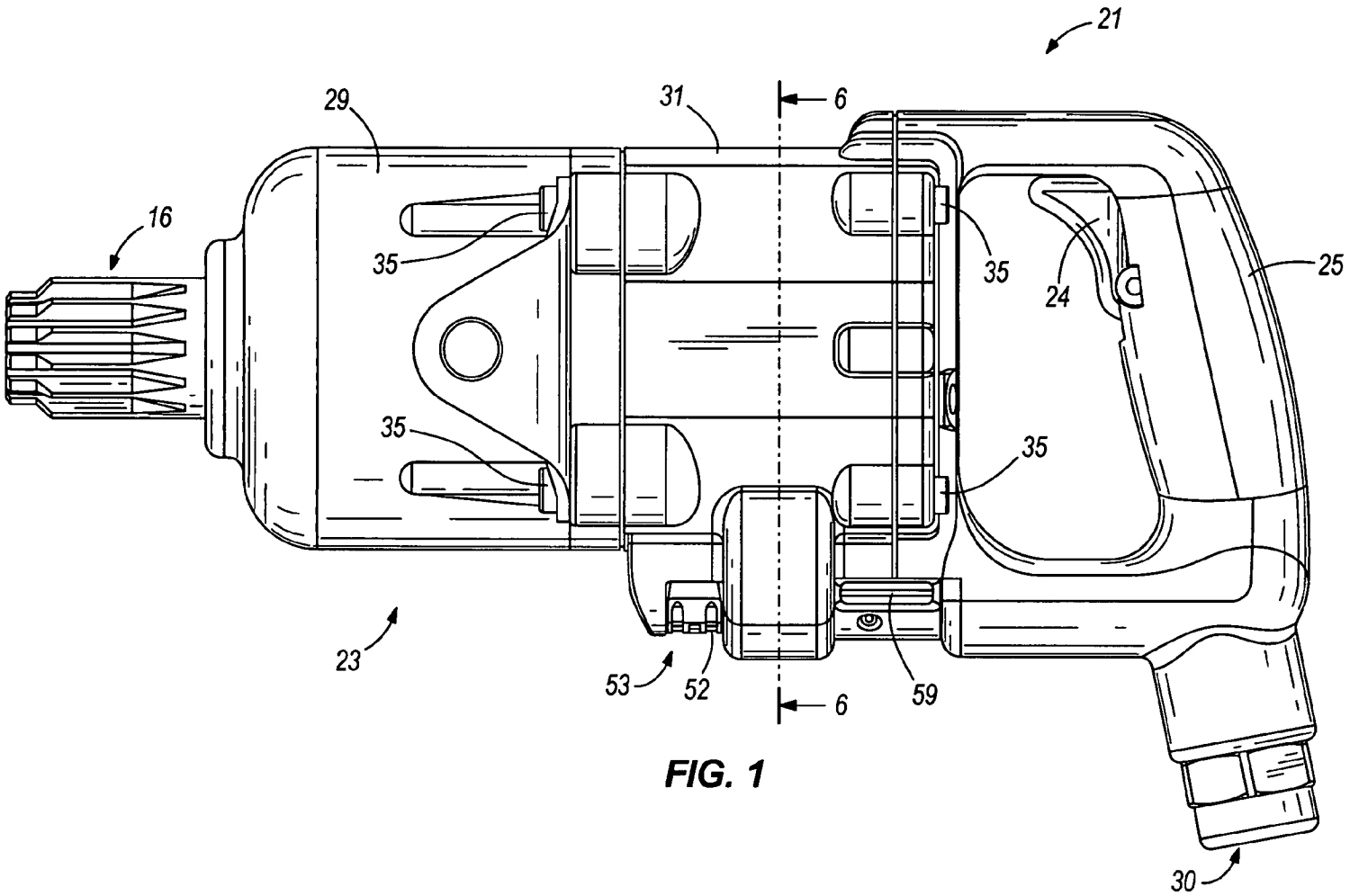
FIG. 1 is a right side elevation of a pneumatic tool of the present invention.

Conventional pneumatic rotary tools generally suffer from airflow losses. By themselves, these air flow losses are problematic in that they cause an overall decrease in the available power of the tool in both the forward and reverse operating directions. Moreover, in biased tools, in which greater power is provided in one direction, the detrimental decrease in power due to air flow losses is especially detrimental in the non-biased direction because these losses further diminish the available power in the non-biased direction, which is already limited due to the increase in torque in the biased direction.

The invention is best understood by reference to the accompanying drawings in which like reference numbers refer to like parts. It is emphasized that, according to common practice, the various dimensions of the component parts as shown in the drawings are not to scale and have been enlarged for clarity.

Figure 2:
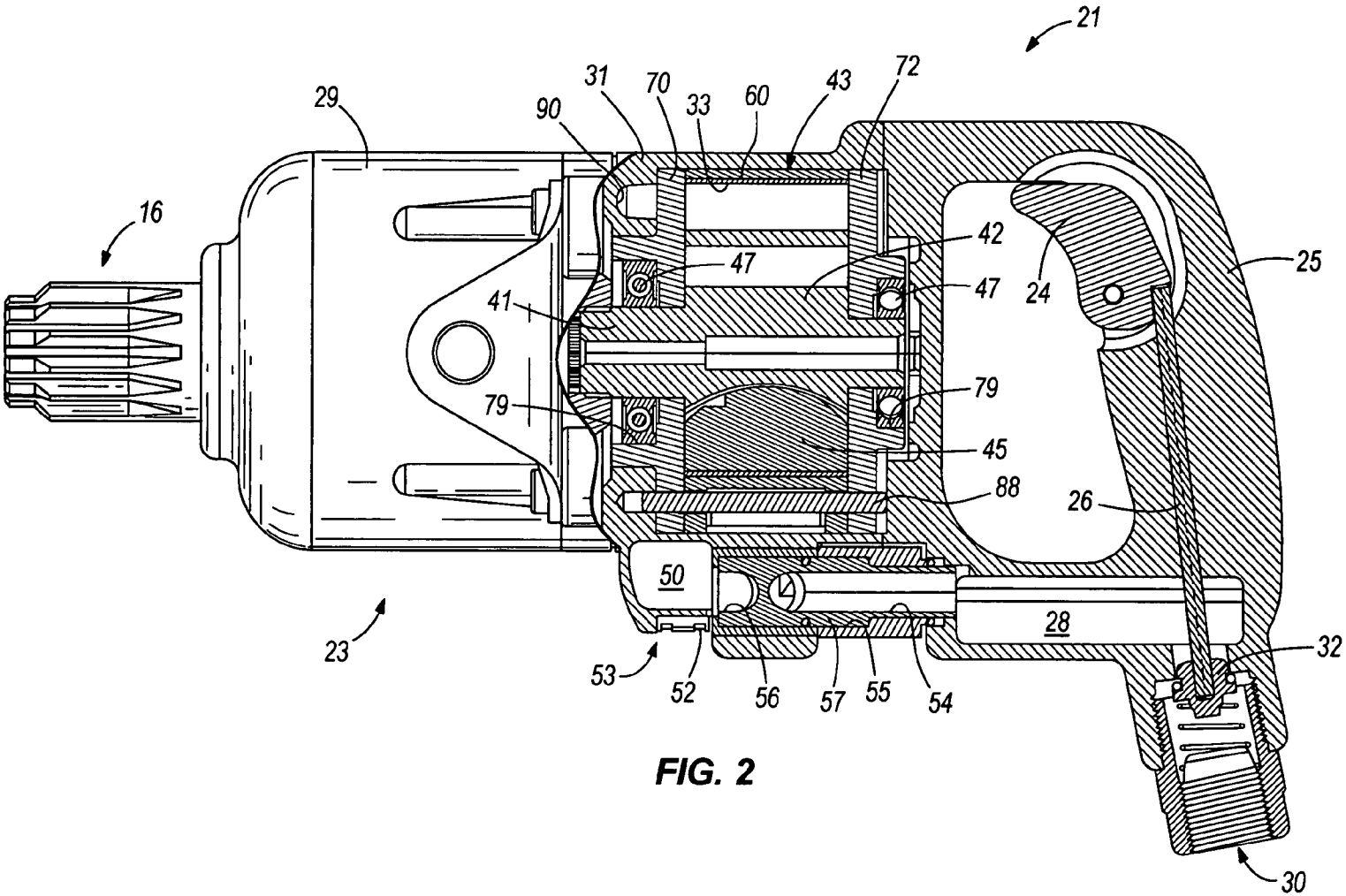
FIG. 2 is a partial sectional view of the pneumatic tool of FIG. 1.

Referring now to the drawings, shown in FIGS. 1 and 2 is a pneumatic tool of the present invention as indicated generally by the reference numeral 21. The pneumatic tool 21 comprises a body, indicated generally at 23, having a hammer case 29 defining a front end of the tool 21, a motor housing 31 adjacent the hammer case, and a handle 25 defining a rear end of the tool. As illustrated, the body 23 is of three piece construction, with the handle 25 and hammer case 29 being secured to the motor housing 31 in a suitable manner (e.g., as by fasteners 35, shown in FIG. 1). The motor housing 31 and handle 25 are typically constructed of aluminum, and the hammer case 29 is constructed of a titanium alloy. It is understood, however, that the tool body 23 may be constructed of other materials and may comprise any number of pieces, including one integrally formed piece, without departing from the scope of this invention.

With reference to FIG. 2, the tool 21 includes various operating components within the body 23. Disposed within motor housing 31 is a pneumatic motor, generally indicated at 43. Pneumatic motor 43 is described in detail below and is a vane motor having a rotor 42 capable of rotation about its rotational axis in a forward (clockwise) direction and a reverse (counter-clockwise) direction. The rotor 42 is rotatably mounted on an eccentric longitudinal axis within a motor chamber 33 defined within a motor cylinder 60 of the motor. The rotor 42 has a plurality of vanes 45 slidably carried within corresponding plurality of radial slots 44 that project radially outward from the rotor and rotationally move between a fluid inlet and an exhaust aperture during rotation of the rotor as described below.

A drive shaft 41 extends outward from opposing ends of the rotor 42 and defines the rotation axis of the motor. The drive shaft 41 is rotatably mounted in the body 23 by suitable bearings 47 disposed in bearing wells 79 of end plates 70, 72 disposed on opposite ends of motor cylinder 60 so that the rotor is supported by the drive shaft 41 and bearings 47. Drive shaft 41 is connected to and rotates a hammer mechanism (not shown) that is disposed in hammer case 29 and drives an output shaft 16. Hammer mechanisms useful in the pneumatic tool shown are known in the art and include, but are not limited to, those disclosed in U.S. Pat. No. 3,661,217 issued to Spencer Maurer, which patent is incorporated herein by reference.

An end of output shaft 16 projects outward from the front end of hammer case 29 and is configured for receiving a wrench socket (not shown) or other suitable fitting (not shown) adapted for engaging the object to be tightened or loosened.

More specifically, pneumatic motor 43 comprises a motor chamber 33 having an inner surface with an eccentric longitudinal axis. A fluid inlet connects the motor chamber 33 and is shown in the form of manifolds that, through inlet ports, provide pressurized motive gas to the motor chamber. As shown in FIG. 7, supply air is provided in the forward direction by a forward air manifold 65 having a manifold inlet 61 that is in fluid communication with inlet ports 62 to the motor chamber 33. In similar fashion, a reverse air manifold (not shown) is provided that connects a manifold inlet 67 that is in fluid communication with inlet ports 63 to the motor chamber 33. Manifold inlets 61 and 67 are located in motor cylinder 60 such that they are in fluid communication with a forward supply port 94 and a reverse supply port 95 in FIG. 6, respectively, when the motor cylinder is inserted into motor housing 31. As described in detail below, upon moving a reversing mechanism 59, a rotary spool element 57 is moved to selectively direct air from an inlet passageway 28 to forward supply port 94 and reverse supply port 95, thereby driving the air motor in a forward or reverse direction, respectively, to effect operation of the tool.

Figure 3:
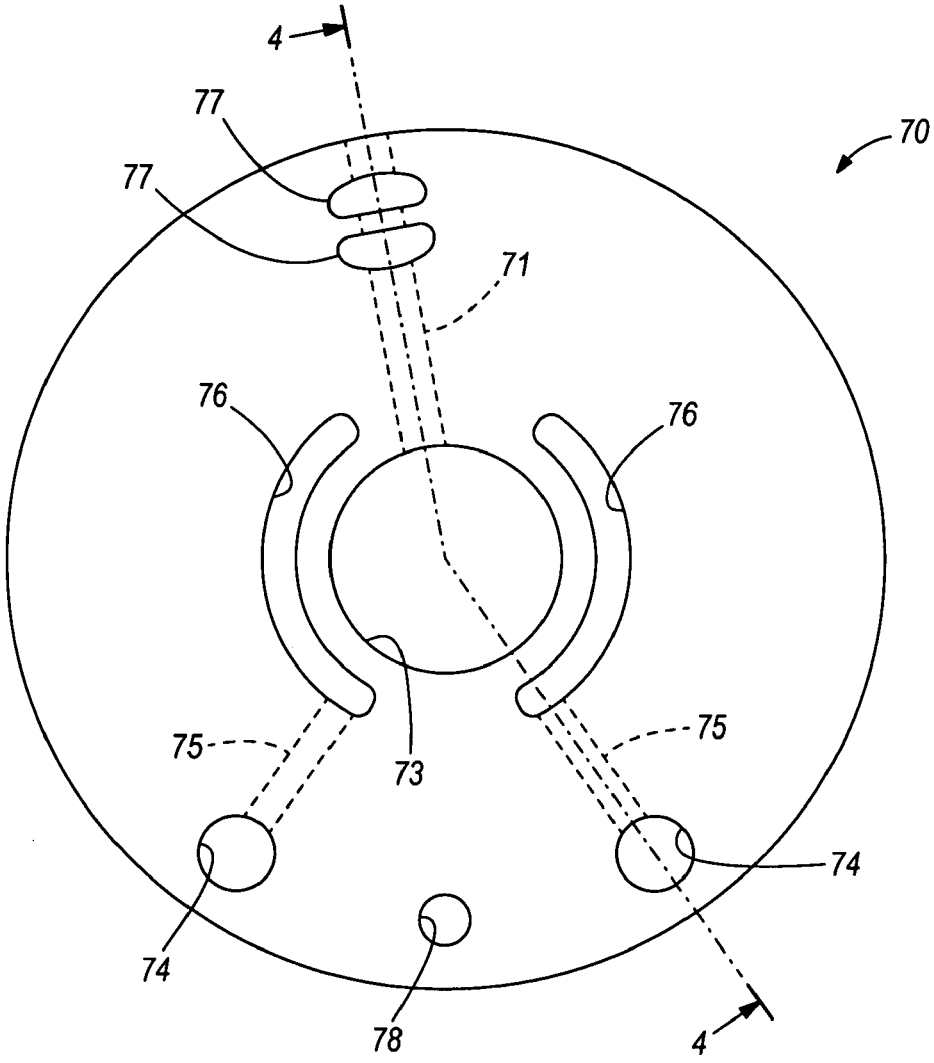
FIG. 3 is an elevational view of an end plate of the pneumatic tool of FIG. 2.
Figure 4:
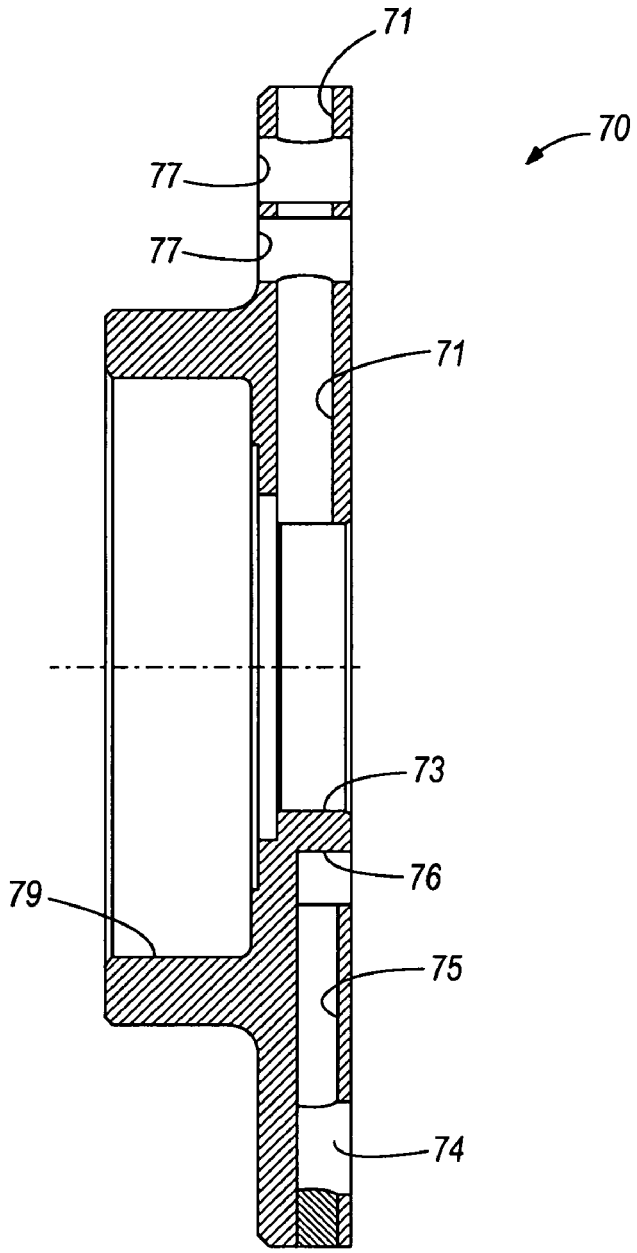
FIG. 4 is a sectional view taken along line "4—4" of FIG. 3.
Figure 5:
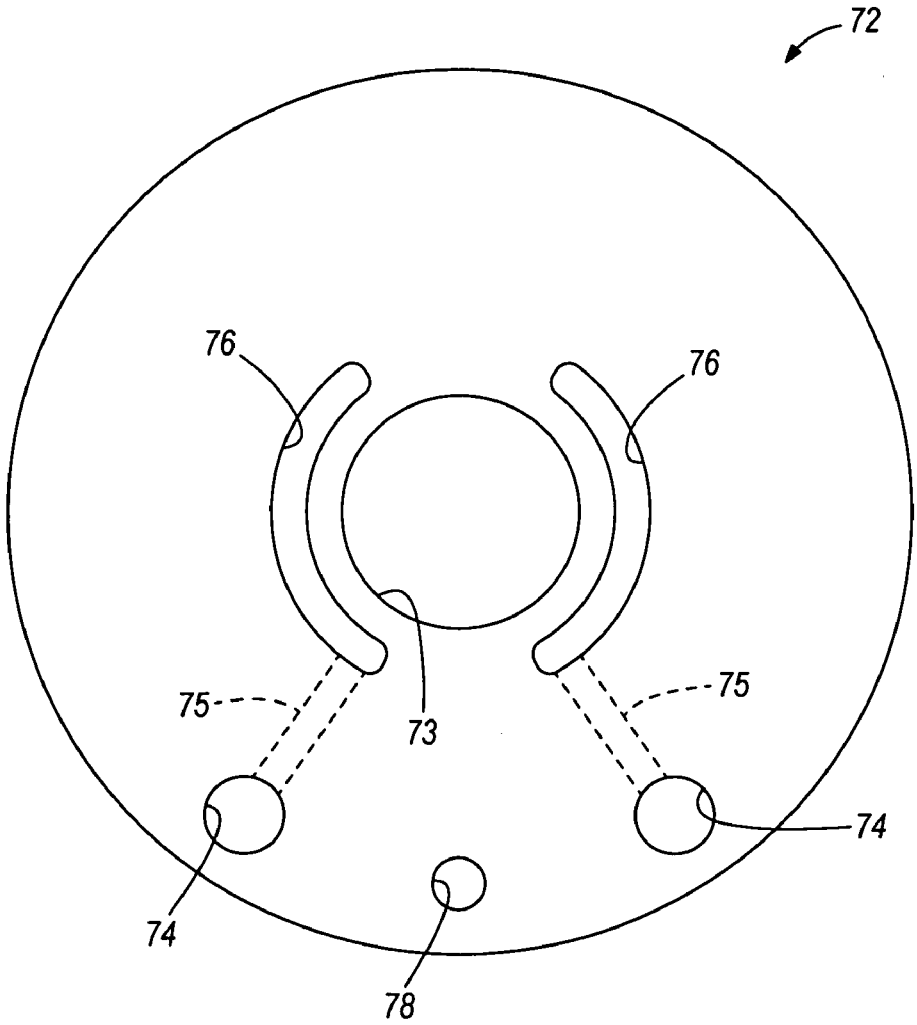
FIG. 5 is an elevational view of an end plate of the pneumatic tool of FIG. 2.

The motor chamber 33 is provided with at least one end wall located transversely to the longitudinal axis with an exhaust aperture located therethrough. Shown in FIGS. 3 and 4 is an end plate 70 that is disposed at the front end of the motor cylinder 60 as shown in FIG. 2. Shown in FIG. 5 is an end plate 72 that is disposed at the rear end of the motor cylinder 60 as shown in FIG. 2. The end plates 70 and 72 may be formed from a brass alloy. Both end plates 70 and 72 are similar in that both of the presenting faces (shown respectively in FIGS. 3 and 5) that face the motor chamber 33 include air inlet bleed ports 74 that are in fluid communication with kidney-shaped ports 76 via internal bleed paths 75 as shown. Air inlet bleed ports 74 register and communicate with inlet ports 64 located in motor cylinder 60 (shown in FIG. 7) and provide pressurized supply air to the kidney-shaped ports 76 during operation, which pressurizes the vane slots 44 to push vanes 45 radially outward during startup of the motor. Alignment apertures 78 are provided in end plates 70, 72 to properly align them with the motor cylinder 60 by registering apertures 78 with apertures 68 provided in motor cylinder 60 and inserting an alignment pin 88 therethrough as shown in FIG. 2.

Shaft receiving bores 73 are provided for conducting ends of drive shaft 41 which are journalled in bearings 47 disposed in bearing wells 79 located concentrically with the shaft receiving bores 73 on the end plates.

Returning to FIG. 3, at least one exhaust aperture 77 is provided through the end plate 70, and is preferably provided in the form of two apertures having a thin land portion between them on which the rotating vanes can ride to facilitate their rotational motion. A hammer case bleed path 71 may also be included that communicates with the exhaust aperture and permits air pressure that may be created in the hammer case 29 to vent to exhaust.

According to one aspect of the present invention, the performance of a bi-directional air motor can be increased in one direction by shifting the exhaust porting in the end plate beyond 180 degrees from the lap point of the motor away from the inlet ports for the direction in which the increase is desired. This is illustrated in the partial sectional schematic view shown in FIG. 7, in which the rotor 42 has a first rotational position 46 with respect to the longitudinal axis where the distance between the rotor 42 and the motor chamber 33 is a minimum (i.e., the lap point). Exhaust apertures 77 are located at a second rotational position with respect to the longitudinal axis such that during rotation of the rotor, the angular distance traveled by each of the plurality of vanes between the first rotational position and the second rotational position in a first rotational direction is greater than 180 degrees.

By locating the exhaust aperture in this position, exhausting of the portion of the motor chamber defined behind the trailing edge each vane occurs in the first rotational direction after the vane reaches its point of maximum radial travel out of its radial slot at rotational position 49. This provides the greatest degree of vane exposure to be realized before exhausting, thereby maximizing the torque available in the first rotational direction to provide a bias. As shown in the figures, the first rotational direction corresponds to the reverse operating direction of pneumatic tool 21, thereby providing a reverse bias. It will be readily recognized that a forward bias could alternately be provided by shifting the position of the exhaust apertures 77 so that their rotational positions are greater than 180 degrees from the lap point in the forward direction.

By biasing the motor exhaust using porting in the end-plate, exhaust air is allowed to exit the motor axially and change direction at only a 90 degree angle, therefore reducing the back pressure at the exhaust of the motor and increasing overall tool performance.

Air motor performance is dependent on the total vane area that is exposed to high pressure air at any given time. To further increase the overall vane area exposed to pressure, the number of vanes 45 provided in the rotor 42 are maximized to include seven vanes that are circumferentially spaced equally in the rotor. This configuration is especially useful in conjunction with the end plate biasing discussed above to realize the added power gained in the bias direction. It will be recognized that although additional vanes may be included for different motor configurations, losses due to friction of the added vane contact with the cylinder should first be determined to ensure that they do not offset gains by the increased vane area.

Handle 25 includes a pneumatic fluid or air inlet 30 for providing motive fluid to pneumatic motor 43 via an inlet passageway 28. A valve 32 is operated by means of a trigger 24 and actuating rod 26 to admit pressure fluid to inlet passageway 28. As shown in FIG. 2, the inlet 30 that connects the pressure fluid supply hose to the tool is preferably placed at an acute angle relative to the axis of the air path into inlet passageway 28. This facilitates the pressure fluid to pass from the supply hose to the motor housing 31 without having to change direction at angles of 90 degrees or more. This, in turn, helps reduce pressure losses of the motive fluid to permit higher pressures to be realized at the motor, therefore, increasing tool performance.

Figure 6:
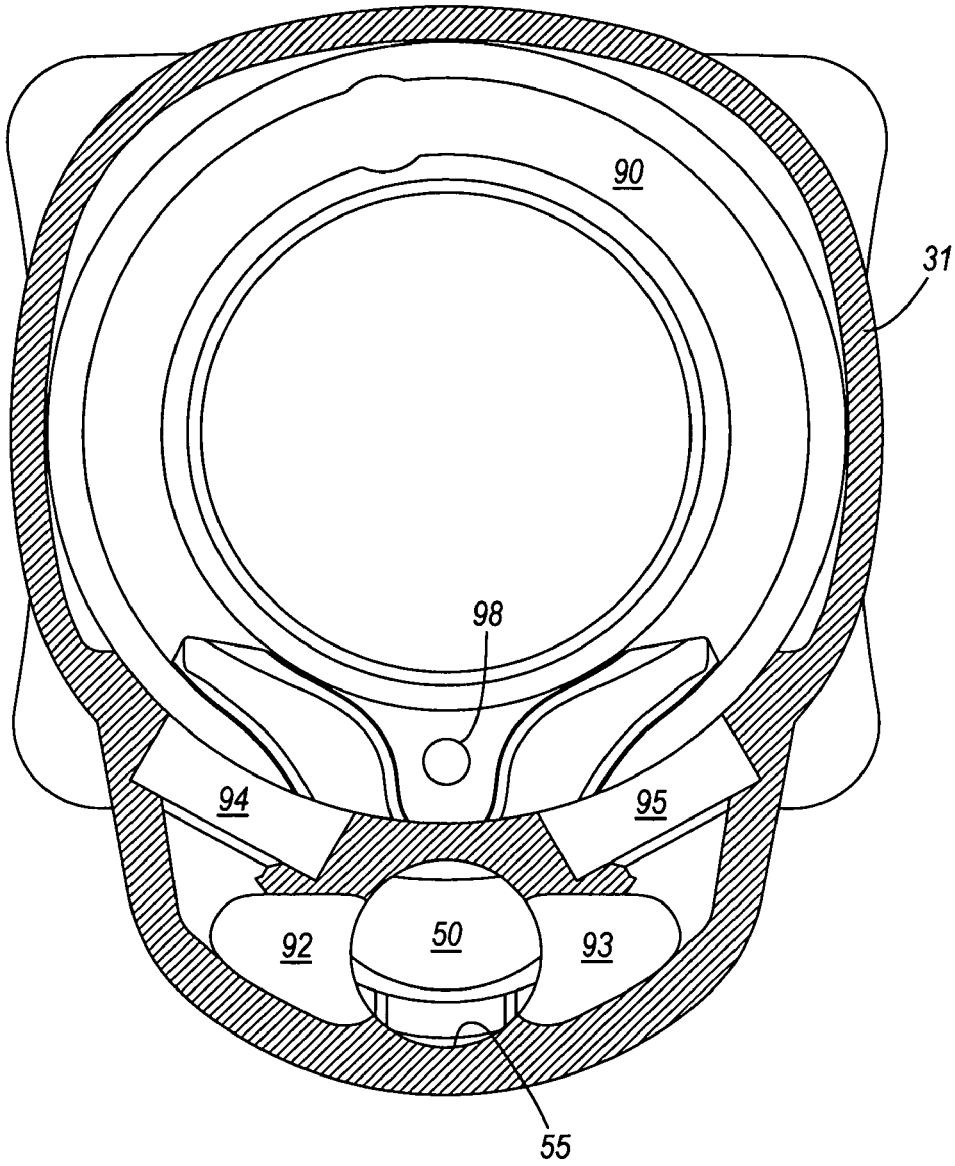
FIG. 6 is a sectional view of the motor housing taken along line "6—6" of FIG. 1 with the internal parts removed.
Figure 7:
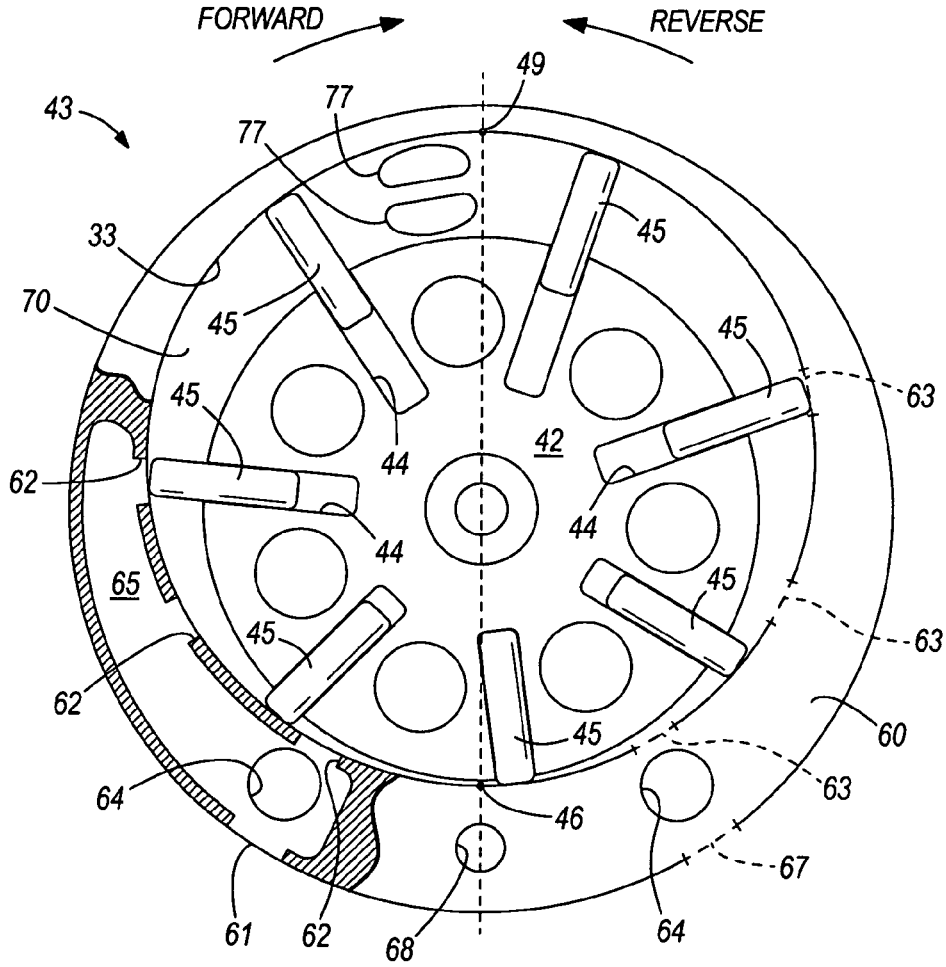
FIG. 7 is a partial sectional schematic view showing a rear view looking forward into the motor cylinder having the rotor and the end plate of FIGS. 2, 3, and 4.

An exhaust channel 90 is formed within an interior surface of the motor housing 31 as shown in FIGS. 2 and 6. Exhaust channel 90 extends generally upward along the inner surface of the motor housing 31 and may be provided as a groove therein, against which an end plate of the motor is placed. The exhaust channel 90 is in communication with the interior of the air motor housing 31 to direct exhaust air from the exhaust ports 77 of an end plate of the air motor as described in greater detail below. At its lower end, exhaust channel 90 is aligned and in fluid communication with an exhaust chamber 50 through which expanded air exhausts through exhaust vents 52 of a vent cover 53 to atmosphere. Exhaust chamber 50 may be provided with an acoustical dampener or muffler (not shown). By aligning the exhaust channel 90 with the exit path of exhaust air out of the tool, directional changes of the exhaust air exiting the tool may be minimized to reduce back pressure and improve tool performance.

Figure 8:
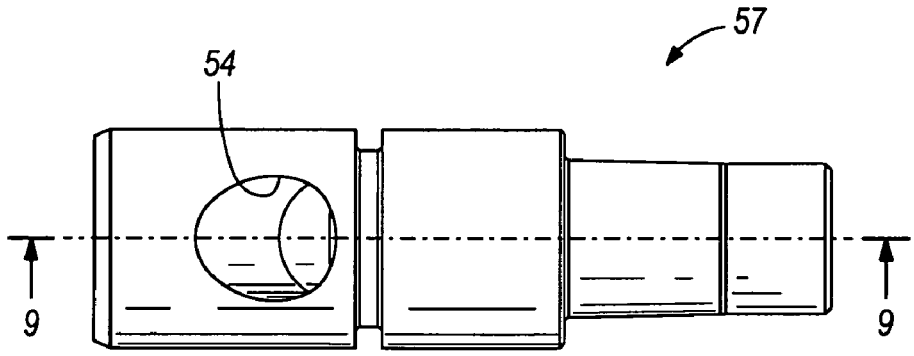
FIG. 8 is a side elevational view of a rotary reversing valve of the pneumatic tool of FIG. 2.
Figure 9:
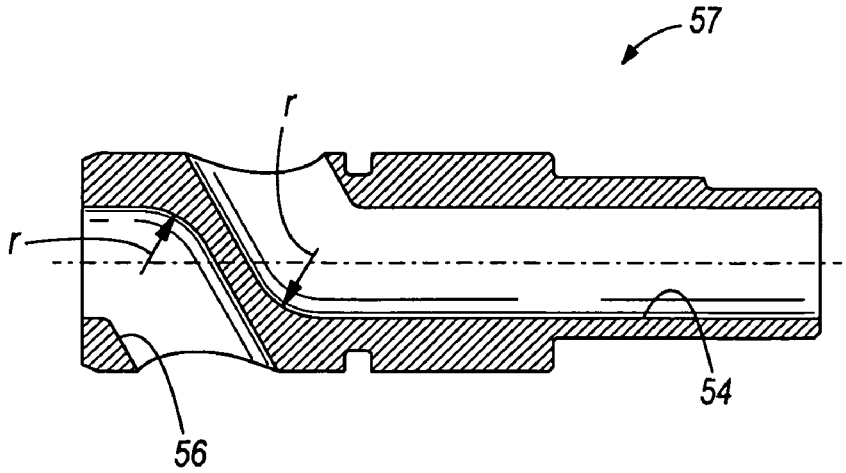
FIG. 9 is a sectional view of the rotary reversing valve taken along line "9—9" of FIG. 8.

With reference to FIG. 6, valve ports 92, 93 are disposed on opposite sides of a valve chamber 55 and are in fluid communication with respective forward supply port 94 and reverse supply port 95 which open to the interior of the motor housing 31. Disposed within valve chamber 55 are a rotary reversing valve 57 in the form of a spool element having an inlet connecting portion 54 and an outlet connecting portion 56 as shown in FIGS. 8 and 9. A first end of inlet connecting portion 54 is in fluid communication with inlet passageway 28 with a second end being in selective communication with valve ports 92 and 93. A first end of outlet connecting portion 56 is in fluid communication with exhaust chamber 50 with a second end being in selective communication with valve ports 92 and 93.

As shown in FIGS. 8 and 9, the inlet connecting portion 54 and outlet connecting portion 56 are provided with internal flow paths having rounded turns, shown as radii "r," that direct the air using a gentle sweeping turns rather than using abrupt angular changes. Gentle changes in air direction facilitate smaller pressure losses, which permit higher pressures to be realized at the motor to increase tool performance. The rounded turns of the inlet connecting portion 54 and outlet connecting portion 56 may be achieved by manufacturing the rotary reversing valve 57 from plastic using an injection molding process. Exemplary materials suitable for manufacturing the rotary reversing valve are polymers such as polycyclohexylene-dimethylene terephthalate available from DuPont™ Corporation, Delaware, as Thermx® CG023 NC010, which is a 20% glass reinforced high performance polyester resin.

A reversing mechanism 59 is provided in the form of a lever that extends outside of body 27 as shown in FIG. 1. Reversing valve 57 and mechanism 59 together permit a user to selectively distribute a motive pressure fluid such as compressed air from inlet passageway 28, through inlet connecting portion 54 to either of valve ports 92 and 93. The valve ports 92 and 93, in turn, selectively channel air through forward supply port 94 and reverse supply port 95 and then to manifold inlets 61 and 67, respectively. In this manner, upon moving reversing mechanism 59 and depressing trigger 24, air is selectively directed from inlet passageway 28 to expand against the vanes 45 to drive the pneumatic motor 43 in a forward or reverse direction.

Although the performance enhancing and directional bias improvements are shown in the figures being used in combination and with a particular type of pneumatic tool, it is contemplated that the enhancing improvements according to the present invention may be incorporated either alone or in combination with one or more of the other improvements and in various pneumatic devices in which performance improvements with or without directional bias is desired. It is understood, therefore, that the invention is capable of modification and therefore is not to be limited to the precise details set forth. Rather, various modifications may be made in the details within the scope and range of equivalents of the claims without departing from the spirit of the invention.

What is claimed is:

1. A pneumatic motor comprising:

a motor chamber having an inner surface with an eccentric longitudinal axis, a motive gas fluid inlet, and at least one end wall located perpendicular to the longitudinal axis of the motor chamber with an exhaust aperture located therethrough such that exhaust enters one face of the end wall and exits an another face of the end wall;

a rotor rotatably disposed in the motor chamber on the eccentric longitudinal axis and having a plurality of radial slots, the rotor defining a first rotational position with respect to the longitudinal axis at which the distance between the rotor and the motor chamber is a minimum;

a plurality of vanes slidably carried within the plurality of radial slots and rotationally moving between the fluid inlet and the exhaust aperture during rotation of the rotor;

wherein the exhaust aperture is located at a second rotational position with respect to the longitudinal axis such that during rotation of the rotor, the angular distance traveled by each of the plurality of vanes between the first rotational position and the second rotational position in a first rotational direction is greater than 180 degrees.

2. The pneumatic motor according to claim 1, wherein the fluid inlet has at least one reverse inlet port located in the chamber that provides motive gas to drive the rotor in the first rotational direction from the first rotational position to the second rotational position and at least one forward inlet port located in the chamber that provides motive gas to drive the rotor in a second rotational direction from the first rotational position to the second rotational position.

3. The pneumatic motor according to claim 2, further comprising a rotary spool that selectively directs motive gas alternately between the reverse and forward inlet ports to rotate the rotor in the first and second rotational directions, the rotary spool having an inlet connecting portion having a first end in fluid communication with an inlet passageway connected to a source of motive gas and a second end in selective communication alternately with the forward and reverse inlet ports, and an outlet connecting portion having a first end in fluid communication with exhaust and a second end in selective communication alternately with the reverse and forward inlet ports, wherein the inlet connecting portion and outlet connecting portion have internal flow paths with rounded turns.

4. The pneumatic motor according to claim 3, wherein the rotary spool comprises an injection molded plastic material.

5. The pneumatic motor according to claim 4, wherein the plastic material comprises a polyester resin.

6. The pneumatic motor according to claim 5, wherein the polyester resin is polycyclohexylene-dimethylene terephthalate.

7. The pneumatic motor according to claim 3, wherein the source of motive gas connected to the inlet passageway provides the motive gas at an acute angle relative to an axis of the inlet passageway.

8. A pneumatic tool comprising the air motor according to claim 3.

9. The pneumatic motor according to claim 1, wherein the at least one end wall comprises at least one end plate in which the exhaust aperture is located.

10. A pneumatic tool comprising the air motor according to claim 9.

11. The pneumatic motor according to claim 1, wherein the at least one wall comprises two end plates with the exhaust aperture being located in one of the end plates.

12. The pneumatic motor according to claim 1, wherein the pneumatic motor further comprises a motor housing having an exhaust channel in fluid communication with an interior of the motor housing, the exhaust channel being aligned and in fluid communication with an exhaust chamber disposed in the motor housing.

13. The pneumatic motor according to claim 12, wherein the exhaust channel is in fluid communication with the exhaust aperture and connects the exhaust aperture to the exhaust chamber.

14. A pneumatic tool comprising the air motor according to claim 12.

15. The pneumatic motor according to claim 1, wherein the plurality of vanes provided in the plurality of radial slots are seven vanes provided in seven radial slots.

16. A pneumatic tool comprising the air motor according to claim 15.

17. A pneumatic tool comprising the air motor according to claim 1.

* * * * *